US008707492B2

(12) United States Patent
Conibear

(10) Patent No.: US 8,707,492 B2
(45) Date of Patent: Apr. 29, 2014

(54) LATH AND PLASTER REMOVAL TOOLS AND SYSTEMS

(76) Inventor: George Conibear, Sterling, NY (US)

( * ) Notice: Subject to any disclaimer, the term of this patent is extended or adjusted under 35 U.S.C. 154(b) by 341 days.

(21) Appl. No.: 13/313,690

(22) Filed: Dec. 7, 2011

(65) Prior Publication Data

US 2012/0192360 A1 Aug. 2, 2012

Related U.S. Application Data

(60) Provisional application No. 61/436,631, filed on Jan. 27, 2011.

(51) Int. Cl.

| | |
|---|---|
| ***B25B 15/00*** | (2006.01) |
| ***B25D 1/00*** | (2006.01) |
| ***B25F 1/00*** | (2006.01) |
| ***B66F 15/00*** | (2006.01) |
| ***B26B 23/00*** | (2006.01) |
| ***E04G 23/08*** | (2006.01) |

(52) U.S. Cl.

CPC ..... *B25F 1/006* (2013.01); *B66F 15/00* (2013.01); *B26B 23/00* (2013.01); *E04G 23/08* (2013.01)

USPC ..... 7/166; 7/145

(58) Field of Classification Search

CPC ..... B25F 1/00; B25F 1/006; B66F 15/00; A62B 3/005; B25D 1/00; B25B 27/02; B26B 23/00; B25G 1/08; B25G 1/085; E04G 23/08

USPC ..... 7/166, 143, 145, 158, 105; 81/490, 81/177.4; 254/131

See application file for complete search history.

(56) References Cited

U.S. PATENT DOCUMENTS

| | | | | |
|---|---|---|---|---|
| 722,899 | A * | 3/1903 | Reeder | 81/490 |
| 1,250,328 | A * | 12/1917 | Langford | 81/177.4 |
| 1,570,192 | A * | 1/1926 | Younick | 254/131 |
| 2,502,271 | A | 3/1950 | Parker et al. | |
| D199,019 | S | 8/1964 | Marson et al. | |
| 4,183,503 | A * | 1/1980 | Ward | 254/131 |
| 4,433,709 | A | 2/1984 | Porter | |
| 6,302,375 | B1 | 10/2001 | Heil et al. | |
| 6,641,113 | B1 | 11/2003 | Budinich | |
| 6,663,083 | B1 * | 12/2003 | Smith | 254/131 |
| 7,225,544 | B2 * | 6/2007 | Petzl | 7/145 |
| 8,127,387 | B2 * | 3/2012 | Tygh | 7/166 |
| 2005/0005457 | A1 | 1/2005 | Wensel et al. | |

* cited by examiner

*Primary Examiner* — Hadi Shakeri

(74) *Attorney, Agent, or Firm* — RG Patent Consulting, LLC; Rachel Gilboy

(57) ABSTRACT

A tool and system for lath and plaster removal. The lath and plaster removal tool is a specialty multi-purpose demolition tool device designed specifically for prying lath and plaster off of walls and ceilings. This tool facilitates the fast and easy removal of both materials at the same time, while also keeping the items separate for easy cleanup. The product is ideal for use by contractors, homeowners, and individuals who wish to remove lath and plaster in buildings. Using this tool of the present invention allows consumers to remove the material in greater quantities, as well as enables them to pry the material off in line with the wall studs, making the process much simpler. The tool may be used in other construction and demolition operations.

1 Claim, 5 Drawing Sheets

LATH AND PLASTER REMOVAL TOOLS AND SYSTEMS

CROSS-REFERENCE TO RELATED APPLICATION

The present application is related to and claims priority from prior provisional application Ser. No. 61/436,631, filed Jan. 27, 2011 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of tools and more specifically relates to lath and plaster removal tools and systems.

2. Description of the Related Art

Drywalling is a building process used to enclose and finish interior walls on modern building constructions. Before drywall was popularized builders used lath and plaster to finish interior walls. The lath and plaster process involves nailing narrow strips of wood horizontally across the wall studs. Each wall frame is covered in lath, tacked at the studs. The lath is typically about two inches wide by four feet long by ¼ inch thick. Each horizontal course of lath is spaced about ¼ inch away from its neighboring courses. Next, temporary lath guides are placed vertically to the wall, usually vertically at the studs. Plaster is then applied, typically using a wooden board as the application tool. The applier drags the board upward over the wall, forcing the plaster into the gaps between the lath to form keys on the backside (to prevent the plaster from separating from the lath) and leaving a layer on the front the depth of the temporary guides, typically about ¼ inch. A helper feeds new plaster onto the board, as the plaster is applied in quantity. When the wall is fully covered, the vertical lath guides are removed, and their slots are filled in, leaving a fairly uniform undercoat. It is standard to apply a second layer in the same fashion, leaving about a half inch of rough, sandy plaster, termed a brown coat. A smooth, white finish coat goes on last. After the plaster is completely dry, the walls are painted. Lath and plaster provides a durable wall construction.

Removing lath and plaster from the framework can be a daunting task when owners update their buildings to use modern materials such as drywall. Conventional hammers and pry bars can be used in the removal process, but using these tools individuals are forced to pry on an angle with the stud which may be awkward, and the process is slow and tedious removing only a small amount of material at a time. Further, using the tools at these awkward orientations may cause the tool to slip off the stud. The conventional process is time consuming and not cost-effective. A more efficient tool is needed.

Various attempts have been made to solve the above-mentioned problems such as those found in U.S. Pat. Nos. 2,502,271; 6,302,375; 6,641,113; D199,019; 2005/0005457; and 4,433,709. This art is representative of demolition tools. None of the above inventions and patents, taken either singly or in combination, is seen to describe the invention as claimed.

Ideally, a lath and plaster removal tool should be durable and efficient in-use and, yet would operate safely and be manufactured at a modest expense. Thus, a need exists for a reliable lath and plaster removal tool system to avoid the above-mentioned problems.

BRIEF SUMMARY OF THE INVENTION

In view of the foregoing disadvantages inherent in the known tool art, the present invention provides a novel lath and plaster removal tool system. The general purpose of the present invention, which will be described subsequently in greater detail is to provide efficiency and cost-effectiveness during lath and plaster removal processes.

The present invention may comprise, in a preferred embodiment, a tool with a 12" handle with a pry bar about 3¼" long 45 degrees from the handle. The key feature is a ½"×3" solid rod that is square with the tool, but on the backside, which would be placed on the face side of the stud. The tool can be placed on either side of the stud, into corners, etc. The tool can be used to pry materials from the ceiling to the floor. The handle may be covered in rubber for easy gripping.

In a preferred embodiment disclosed herein a lath and plaster removal tool system comprises a demolition tool with a method of use. The demolition tool comprises a handle-shaft having a proximate end and a distal end and a head. The head includes: a pry-lever a head-support; and at least one cross-bar. The pry-lever has a right side face; a left side face; a top surface; a bottom surface; a front face; and a rear face. The right side face is located opposite the left side face of the pry-lever (on the opposite side of the pry-lever). The top surface comprises an arc-edge-profile whereby a user may gradually pry about a cammed-rotation of motion, controlling torque via this feature. The top surface is located opposite the bottom surface; the front face joins the top surface to the bottom surface forming a pick-end with an apex suitable for piercing a surface. The rear face of the pry-lever is located opposite the front face. The head is mounted on the distal end of handle-shaft to form the demolition tool; the handle-shaft comprising a hand-engageable portion. The pry-lever of the head, in combination with the handle-shaft create a first class lever (system).

The head-support provides a support mass suitable to distribute a pry-load from the handle-shaft through the pry-lever to prevent flexing, distortion of the pry-lever and to give weight to impart more force using the present invention. The cross-bar provides a surface-area increaser for distributing a pry-force imparted by the demolition tool on a lath and plaster assembly (or other suitable surface). The cross-bars (preferably exactly two, but may be one or more in alternate embodiments) comprise threads; wherein the cross-bar(s) are insertable and removable from the pry-bar. The proximate end of the handle-shaft comprises a receiver; wherein the cross-bars are threadably-insertable into the receiver in the handle-shaft for storage during non-use periods. This receiver is located parallel to a length of the handle-shaft, the receiver located within the confines of the handle-shaft.

The rods comprise a left side rod-member and a right side rod-member; wherein the left side rod-member is removably-attached perpendicular into the left side face of the pry-lever; and the right side rod-member is removably-attached perpendicular into the right side face of the pry-lever. The head-support comprises a hammer face suitable for use in demolition. The proximate end of the handle-shaft terminates with a flared-butt-end to prevent a hand of a user from slipping off the hand-engageable portion. In preferred embodiments the handle-shaft comprises a rubber coating to enhance gripping by the user. In this particular embodiment the handle-shaft is about twelve inches long, the pry bar is about 3¼ inches long and the pry-bar is oriented about 45 degrees from the handle-shaft (more or less, but 45 degrees preferred because of the prying force available and that the tool can be placed on either side of the stud, into corners with relative ease.) The cross-bar is about ½" in diameter and about 3 inches long and comprises solid rod(s). The demolition tool is useful for removing lath strips and plaster from at least one frame, the frame comprising a substantially vertical (or horizontal) stud structure (wall, floor or ceiling or other such structure and surface.) The present invention may also be used in a host of different applications such as roofing and other demolition projects.

A methods of use the inventor has disclosed herein recommends with a firm grip jabbing (piercing) the tool into a lath and plaster wall at eye level across the entire wall. Then (if right-handed person) start from left to right inserting the tool between every other stud and prying three rows of lath off at a time. Allowing the plaster to fall to the floor while the three rows of lath remain in the left hand, then placing lath in a pile away from the plaster. Keeping the lath and plaster separate for easy cleanup may be thus achieved. The lath may then be bundled with string and carried away. The tool may be turned over and used to strip the wall to the ceiling. The tool is also designed to go right into corners as well making it efficient in use.

The present invention holds significant improvements and serves as a lath and plaster removal tool system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, lath and plaster removal tool, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a demolition tool device and more particularly to a lath and plaster removal tool as used to improve the efficiency by which lath and plaster may be removed.

Generally speaking, the lath and plaster removal tool is a specialty multi-purpose demolition tool device designed specifically for prying lath and plaster off of walls and ceilings. The tool may also be used in different construction and demolition applications. This tool facilitates the fast and easy removal of both materials (lath and plaster) at the same time, while also keeping the items separate for easy cleanup. The product is ideal for use by contractors, homeowners, and individuals who wish to remove lath and plaster in their home or business. Using the tool of the present invention allows consumers to remove the material in greater quantities, as well as enables them to pry the material off in line with the wall studs, making the process much simpler.

Figure 1:
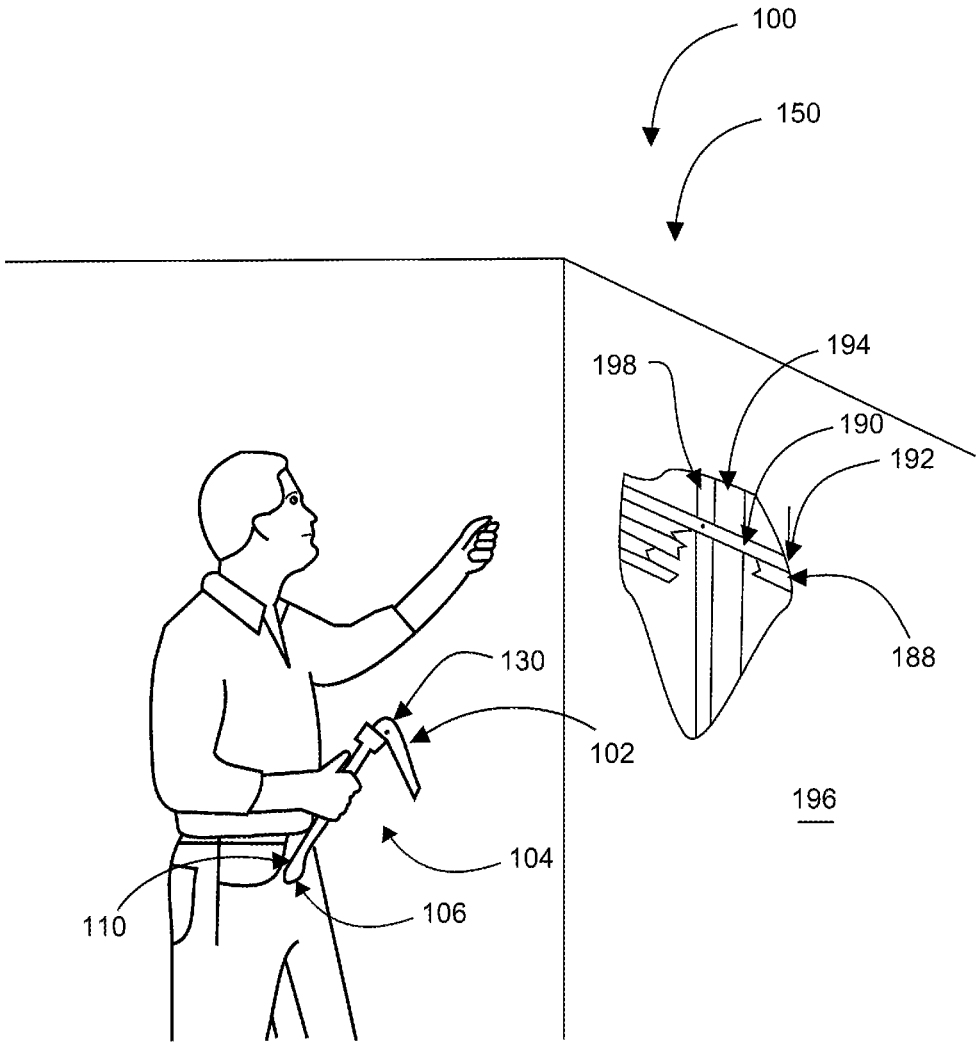
FIG. 1 shows a perspective view illustrating a lath and plaster removal tool in an in-use condition according to an embodiment of the present invention.

Referring to the drawings by numerals of reference there is shown in FIG. 1, a perspective view illustrating lath and plaster removal tool 104 in an in-use condition 150 according to an embodiment of the present invention.

Lath and plaster removal tool system 100 preferably comprises demolition tool 102. Demolition tool 102 comprises handle-shaft 110 having proximate end 112 and distal end 114. Demolition tool 102 comprises head 120 including pry-lever 130 having right side face 132; left side face 134; top surface 136; bottom surface 140; front face 142; and rear face 144. Demolition tool 102 also comprises head-support 160 in preferred embodiments so promote durability in use; and at least one cross-bar 170. Head 120 is mounted on distal end 114 of handle-shaft 110 to form demolition tool 102. Proximate end 112 of handle-shaft 110 comprises hand-engageable portion 118 such that a user may grip and use the device.

Pry-lever 130 of head 120 in combination with handle-shaft 110 create a first class lever useful for prying operations/tasks. Head-support 160 provides a support mass suitable to distribute a pry-load from handle-shaft 110 through pry-lever 130. Right side face 132 is located opposite left side face 134 of pry-lever 130. Top surface 136 comprises an arc-edge-profile 138 in preferred embodiments, thereby creating a cam-shaped edge. Top surface 136 is located opposite bottom surface 140. Front face 142 joins (connects) top surface 136 to bottom surface 140 forming pick-end 146. Pick-end 146 comprises an angled edge suitable to pierce wall structures. Rear face 144 of pry-lever 130 is located opposite front face 142, ('opposite' orientation) as indicated in the drawing(s). Cross-bar 170 provides a surface-area increaser for distributing a pry-force imparted by demolition tool 102 on a lath and plaster assembly 188. Demolition tool 102 is useful for removing lath strips 190 (preferably three at once) and plaster 192 from at least one frame 198.

A key feature is the about ½" by about 3" solid rod 174 that is square (perpendicular) with demolition tool 102, but on the backside, which is placed on the face side of stud 194 when used. Demolition tool 102 can be placed on either side of the stud 194, into corners, etc. making demolition tool 102 relatively easy to use in tight spaces. As such, demolition tool 102 can be used to pry materials from the ceiling to the floor along wall 196. Handle-shaft 110 may be covered in rubber (rubber coating 116 or sleeve or the like) for ease in gripping the device. Pry-lever 130 may be made from about ¼" thick plate such that demolition tool 102 is light enough to use over an extended duration. Other embodiments may comprise thicker plate such as ⅜" which may be more durable and allow for more threading to hold cross-bar 170 secure; however the inventor has found these embodiments may be tiresome to use. Another option suggested is to have a thicker profile around threading and the remainder of the device of thinner material.

Figure 5:
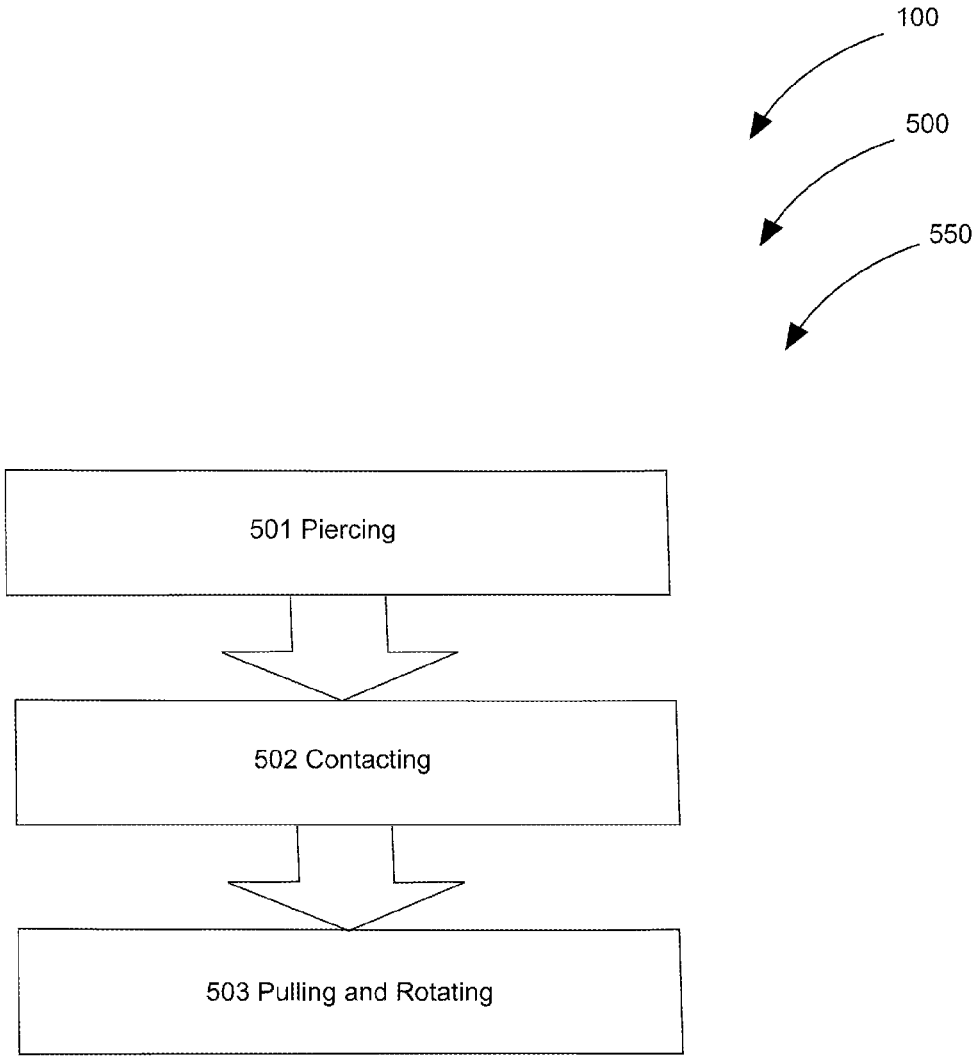
FIG. 5 is a flowchart illustrating a method of using the lath and plaster removal tool according to an embodiment of the present invention of FIGS. 1-4.

Further, using the present invention may decrease dust and may decrease cleanup times since lath strips 190 are effectively and efficiently separated from plaster 192 using the method of use 500 described in FIG. 5. The inventor has found it ideal to remove three lath strips 190 at a time thus bottom surface 140 of pry-lever 130 is suitably sized to fit this application. Upon reading this specification, it should be appreciated that, under appropriate circumstances, considering such issues as user preferences, design preference, structural requirements, marketing preferences, cost, available materials, technological advances, etc., other materials for use in head 120 such as, for example, ferrous hardened steel and non-ferrous materials, composites, etc., and materials for and handle-shaft 110 may comprise wood, composites, plastic(s) such as polypropylene, ferrous or non-ferrous materials may be sufficient. Other dimensions may also be used and still be considered within the scope of the present invention.

Figure 2A:
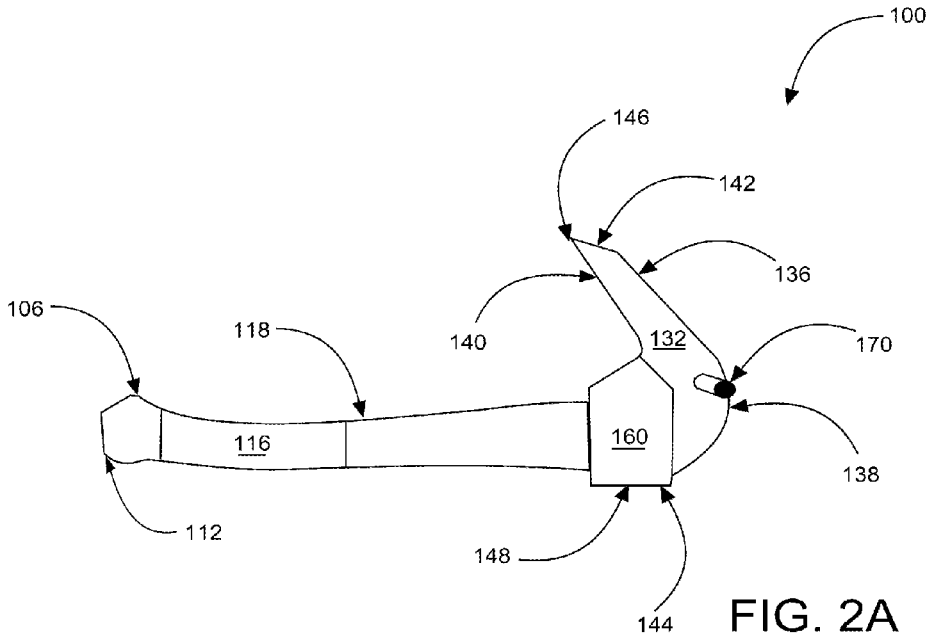
FIG. 2A is a side view illustrating the lath and plaster removal tool according to an embodiment of the present invention of FIG. 1.

Referring now to FIG. 2A, showing a side view illustrating lath and plaster removal tool 104 according to an embodiment of the present invention of FIG. 1.

Proximate end 112 of handle-shaft 110 preferably terminates with flared-butt-end 106 to prevent a hand of a user from slipping off hand-engageable portion 118. Head-support 160 comprises hammer face 148, also useful during demolition projects. Cross-bar 170 is about ½" in diameter and about 3 inches long and comprises a solid rod 174 in preferred embodiments.

Figure 2B:
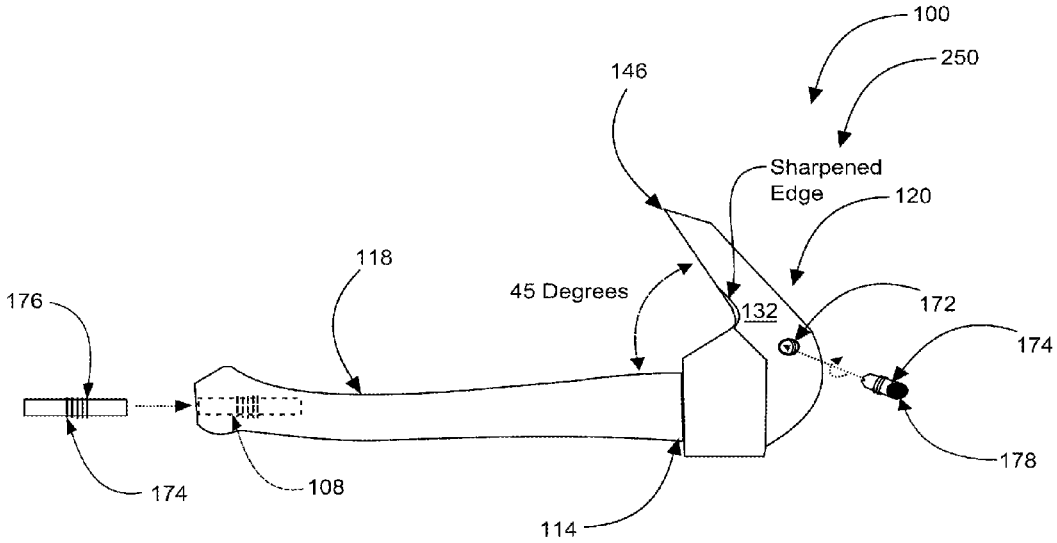
FIG. 2B is a side view illustrating the lath and plaster removal tool according to another embodiment of the present invention of FIG. 1.

FIG. 2B is a side view illustrating lath and plaster removal tool 104 according to another embodiment of the present invention of FIG. 1.

Cross-bar 170 may comprise threads 172 such that it may be threaded into receiver 108, in preferred embodiments (preferably in the middle of cross-bar 170 with non-threaded ends slightly smaller in diameter to allow ease of passage). Cross-bar 170 may comprise an end that has a slot(s) suitable to receive a screwdriver to tighten or loosen cross-bar 170. Receiver 108 also comprises threads 172 to threadingly receive cross-bar 170. In alternate embodiments cross-bar 170 may be friction-inserted in a cavity (receiver 108) and held via friction force. Lath and plaster removal tool 104 may comprise no cross-bar 170 in alternate embodiments.

Cross-bar 170 is removable in preferred embodiments making it multi-purpose for use with drywall construction or during non-use condition(s) 250. In embodiments wherein the present invention is multi-purpose for use with drywall constructions and the like, pry-lever 130 may be sharpened on the lower side (throat) of head 120 to cut through drywall and pull demolition tool 102 down through the drywall (essentially cutting and pulling the drywall) for demolition removal. Cross-bar 170 is desirably removed for use with drywall projects such that it is easier to pierce the drywall.

As mentioned previously, proximate end 112 of handle-shaft 110 comprises at least one receiver 108; wherein cross-bar 170 is threadably-insertable into receiver 108 in handle-shaft 110. Receiver 108 is preferably located parallel to a length of handle-shaft 110; receiver 108 located within handle-shaft 110. Handle-shaft 110 is about twelve inches long, pry-lever 130 about 3¼ inches long and oriented about 45 degrees from handle-shaft 110 in preferred embodiments. A 45 degrees orientation is preferred to prevent 'up-pulling' which tends to tire the user. It is desirable that the user work the tool with his/her arms in as low of a position as possible to remain comfortable. It is undesirable that demolition tool 102 be used above the shoulder height of the user; however if it is to be used above shoulder height demolition tool 102 may be placed in a reverse (upside-down) position and used to minimize user fatigue.

Figure 3:
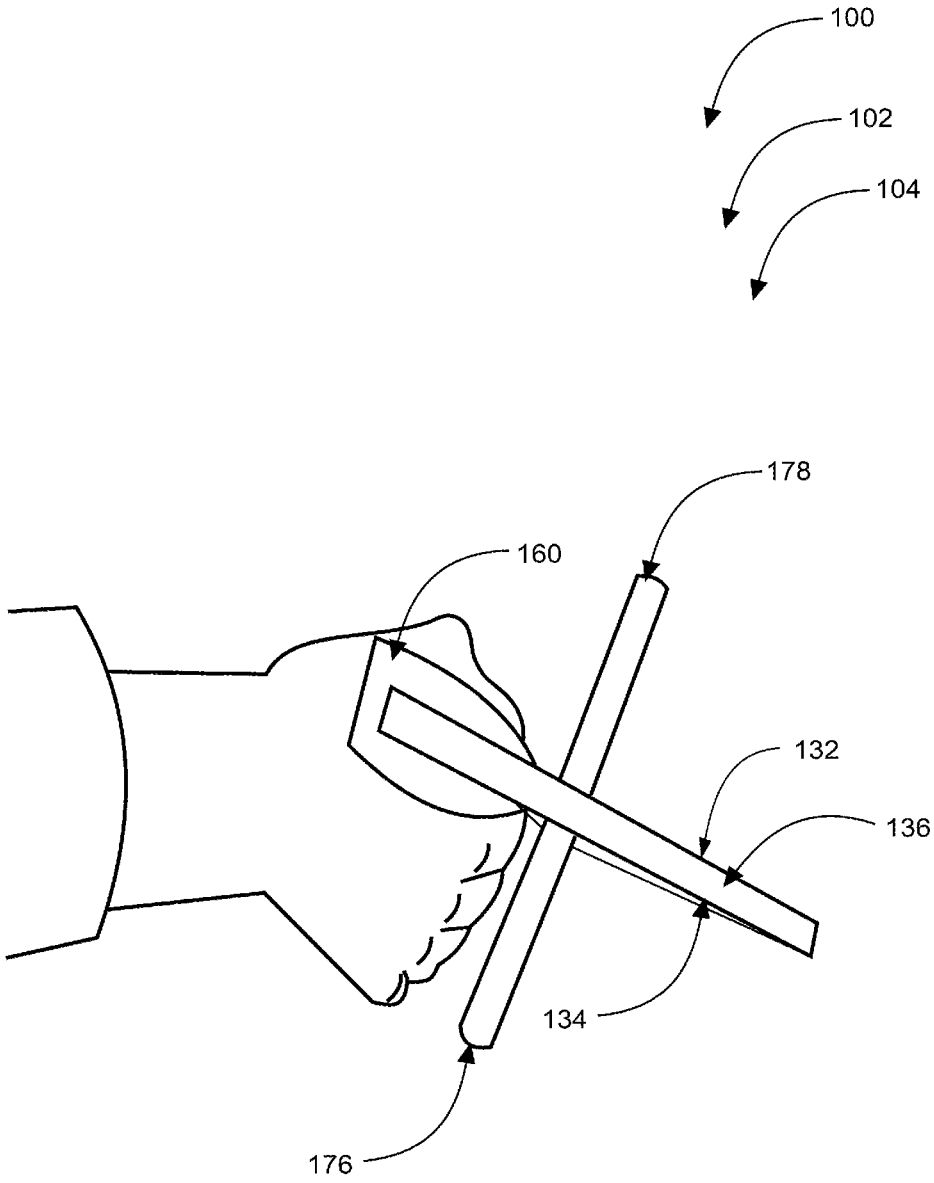
FIG. 3 is a top perspective view illustrating the lath and plaster removal tool according to embodiment of the present invention of FIGS. 1-2B.

Referring now to FIG. 3, a top perspective view illustrating lath and plaster removal tool 104 according to embodiment of the present invention of FIGS. 1-2B.

Cross-bar 170 may comprise exactly two rods 174 or may comprise exactly one rod 174. It is preferred that cross-bar 170 be threaded into pry-lever 130 (during in-use condition 150) from the left side such that as demolition tool 102 is used and cross-bar 170 engages stud 194 that cross-bar 170 is tightened not loosened.

Rods 174 may comprise a left side rod-member 176 and a right side rod-member 178; wherein left side rod-member 176 is fixedly-attached perpendicular to left side face 134 of pry-lever 130 and right side rod-member 178 is fixedly-attached perpendicular to right side face 132 of pry-lever 130.

Figure 4:
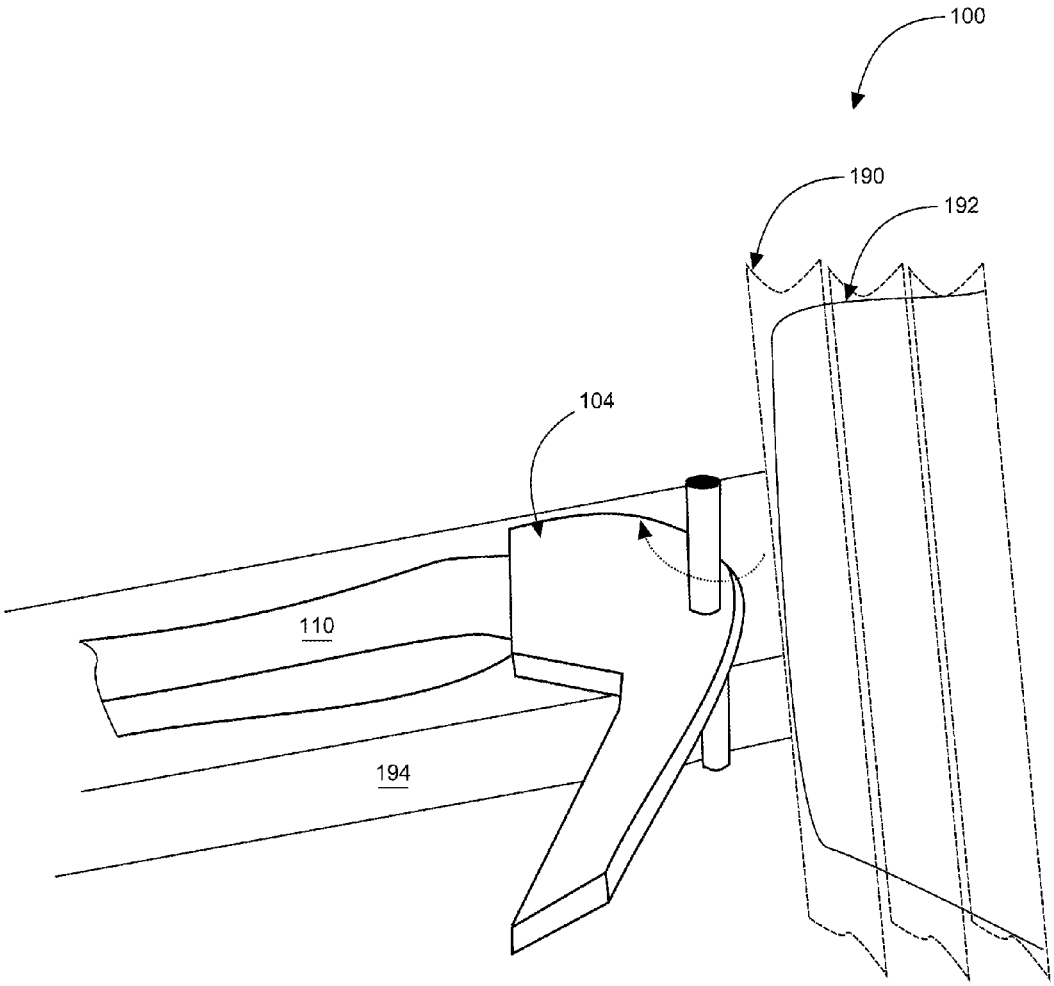
FIG. 4 is another perspective view illustrating the lath and plaster removal tool according to an embodiment of the present invention of FIGS. 1-3.

Referring now to FIG. 4, showing another perspective view illustrating lath and plaster removal tool 104 according to an embodiment of the present invention of FIGS. 1-3.

Handle-shaft 110 comprises rubber coating 116 to enhance gripping by the user. Demolition tool 102 is useful for removing lath strips 190 and plaster 192 from frame 198, frame 198 comprising studs 194 forming a vertical wall structure, as shown in FIG. 1. Demolition tool 102 is useful for removing lath strips 190 and plaster 192 in a controlled manner from frame 198, frame 198 comprising studs 194 forming a horizontal floor structure. The present invention when used serves to minimize dust and removes three lath strips 190 and plaster 192 in one 'bite'.

Lath and plaster removal tool system 100 may be sold as kit 440 comprising the following parts: at least one demolition tool 102 (drywall version and/or lath and plaster removal tool 104); at least one (removable) cross-bar 170; and a set of user instructions. Lath and plaster removal tool system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different prybar orientations/combinations (removable or not), parts may be sold separately, etc., may be sufficient.

Referring now to FIG. 5, a flowchart 550 illustrating a method of using (method of use 500) lath and plaster removal tool 104 according to an embodiment of the present invention of FIGS. 1-4.

A method of using (method of use 500) lath and plaster removal tool 104 (demolition tool 102) may comprise the steps of: step one 501 piercing wall 196 with pick-end 146 of demolition tool 102; step two 502 putting cross-bar 170 of demolition tool 102 into contact with a face of stud 194 such that pry-lever 130 is located on one side (or the other) of stud 194; and step three 503 pulling and rotating lath and plaster removal tool 104 to remove a portion of wall 196 (such as lath and plaster assembly 188) off of stud 194 in a demolition process. Wall 196 in method of use 500 comprises lath and plaster; however demolition tool 102 may be used for other applications such as with drywall as discussed previously.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A lath and plaster removal tool system comprising:

a demolition tool comprising;

a handle-shaft having a proximate end and a distal end;

a head including;

a pry-lever having;

a right side face;

a left side face;

a top surface;

a bottom surface;

a front face; and a rear face;

a head-support;

at least one cross-bar;

wherein said head is mounted on said distal end of said handle-shaft to form said demolition tool;

wherein said proximate end of said handle-shaft comprises a hand-engageable portion;

wherein said pry-lever of said head in combination with said handle-shaft create a first class lever;

wherein said head-support provides a support mass suitable to distribute a pry-load from said handle-shaft through said pry-lever;

wherein said right side face is located opposite said left side face of said pry-lever;

wherein said top surface comprises an arc-edge-profile;

wherein said top surface is located opposite said bottom surface;

wherein said front face joins said top surface to said bottom surface forming a pick-end;

wherein said rear face of said pry-lever is located opposite said front face;

wherein said at least one cross-bar provides a surface-area increaser for distributing a pry-force imparted by said demolition tool on a lath and plaster assembly;

wherein said cross-bar comprises threads;

wherein said cross-bar is removable;

wherein said proximate end of said handle-shaft comprises a receiver;

wherein said cross-bar is threadably-insertable into said receiver in said handle-shaft;

wherein said receiver is located parallel to a length of said handle-shaft, said receiver located within said handle-shaft;

wherein said cross-bar comprises exactly two rods;

wherein said rods comprise a left side rod-member and a right side rod-member;

wherein said left side rod-member is removably-attached perpendicular into said left side face of said pry-lever;

wherein said right side rod-member is removably-attached perpendicular into said right side face of said pry-lever;

wherein said head-support comprises a hammer face;

wherein said proximate end of said handle-shaft terminating with a flared-butt-end to prevent a hand of a user from slipping off said hand-engageable portion;

wherein said handle-shaft comprises a rubber coating to enhance gripping by said user;

wherein said handle-shaft is about twelve inches long, said pry-lever about 3¼ inches long and oriented about 45 degrees from said handle-shaft;

wherein said cross-bar is about ½" in diameter and about 3 inches long and comprises solid said rods; and wherein said demolition tool is useful for removing lath strips and plaster from at least one frame, said frame comprising a vertical stud structure.

* * * * *